US011486076B2

(12) United States Patent
Ye et al.

(10) Patent No.: US 11,486,076 B2
(45) Date of Patent: Nov. 1, 2022

(54) CLOTHES TREATING APPARATUS

(71) Applicant: LG Electronics Inc., Seoul (KR)

(72) Inventors: Sungmin Ye, Seoul (KR); Sungho Song, Seoul (KR); Taehee Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 460 days.

(21) Appl. No.: 16/589,712

(22) Filed: Oct. 1, 2019

(65) Prior Publication Data

US 2020/0032442 A1 Jan. 30, 2020

Related U.S. Application Data

(63) Continuation of application No. 15/166,543, filed on May 27, 2016, now abandoned.

(30) Foreign Application Priority Data

Jun. 2, 2015 (KR) ..... 10-2015-0078078

(51) Int. Cl.
*D06F 39/00* (2020.01)
*D06F 58/20* (2006.01)
(Continued)

(52) U.S. Cl.
CPC ..... *D06F 39/008* (2013.01); *B05B 7/2448* (2013.01); *D06F 58/203* (2013.01);
(Continued)

(58) Field of Classification Search
CPC ..... B05B 1/26; B05B 7/2448; B05B 7/2429; D06F 58/10; D06F 58/203; D06F 39/008; D06F 73/02; D06F 2103/60
See application file for complete search history.

(56) References Cited

U.S. PATENT DOCUMENTS 2,820,578 A 1/1958 Dickman
6,427,365 B2 8/2002 MacGregor
(Continued)

FOREIGN PATENT DOCUMENTS

CN 102216516 10/2011
CN 102405315 4/2012
(Continued)

OTHER PUBLICATIONS

Chinese Office Action in Chinese Application No. 201610382349.5, dated Dec. 28, 2017, 19 pages (with English translation).
(Continued)

*Primary Examiner* — Michael E Barr
*Assistant Examiner* — Kevin G Lee
(74) *Attorney, Agent, or Firm* — Fish & Richardson P.C.

(57) ABSTRACT

A clothes treating apparatus includes a cabinet, a steam generator configured to generate steam, and a solution storing container configured to store a solution. The clothes treating apparatus also includes a steam spraying portion that is coupled to the steam generator and that is configured to spray steam and a solution spraying portion that is coupled to the solution storing container and that is configured to spray the solution. The steam spraying portion is configured to spray steam to control air pressure at the outlet of the solution spraying portion.

20 Claims, 8 Drawing Sheets

(51) Int. Cl.

| | |
|---|---|
| ***D06F 73/02*** | (2006.01) |
| ***B05B 7/24*** | (2006.01) |
| *D06F 58/10* | (2006.01) |
| *D06F 39/02* | (2006.01) |
| *D06F 105/38* | (2020.01) |
| *D06F 103/60* | (2020.01) |
| *D06F 17/12* | (2006.01) |
| *D06F 39/08* | (2006.01) |

(52) U.S. Cl.

CPC ..... *D06F 73/02* (2013.01); *B05B 7/2429* (2013.01); *D06F 17/12* (2013.01); *D06F 39/022* (2013.01); *D06F 39/088* (2013.01); *D06F 58/10* (2013.01); *D06F 2103/60* (2020.02); *D06F 2105/38* (2020.02)

(56) References Cited

U.S. PATENT DOCUMENTS

| | | | | |
|---|---|---|---|---|
| 6,543,705 | B1 | 4/2003 | Liao | |
| 2008/0054025 | A1 | 3/2008 | Tsai | |
| 2008/0121737 | A1* | 5/2008 | Friis | A47K 3/281 239/315 |
| 2009/0260406 | A1 | 10/2009 | Bae et al. | |
| 2010/0252658 | A1* | 10/2010 | Honeyands | A45D 20/16 239/398 |
| 2010/0282866 | A1* | 11/2010 | Gilpatrick | B08B 3/026 239/581.1 |
| 2011/0016930 | A1 | 1/2011 | Moon | |
| 2012/0047662 | A1 | 3/2012 | Koch | |
| 2012/0317729 | A1 | 12/2012 | Song | |
| 2013/0213507 | A1 | 8/2013 | Vrdoljak | |
| 2014/0075683 | A1 | 3/2014 | Kim | |
| 2015/0147473 | A1 | 5/2015 | Tse | |

FOREIGN PATENT DOCUMENTS

| | | |
|---|---|---|
| CN | 103153150 | 6/2013 |
| CN | 106149291 | 11/2016 |
| DE | 3408136 | 9/1985 |
| EP | 0953669 | 11/1999 |
| JP | 54023318 | 2/1979 |
| JP | 197923318 | 2/1979 |
| JP | 57136451 | 8/1982 |
| JP | 1982136451 | 8/1982 |
| JP | H04189400 | 7/1992 |
| JP | 199419857 | 3/1994 |
| JP | H06019857 | 5/1994 |
| JP | 7059278 | 6/1995 |
| JP | 03326493 | 9/2002 |
| JP | 2013534182 | 9/2013 |
| KR | 100444005 | 11/2004 |
| KR | 1020120074557 | 7/2012 |
| KR | 1020140108455 | 9/2014 |
| WO | 2009020312 | 2/2009 |
| WO | 2010145869 | 12/2010 |
| WO | 2011020705 | 2/2011 |
| WO | 2012013539 | 2/2012 |

OTHER PUBLICATIONS

Extended European Search Report issued in European Application No. 16172063.6 dated Oct. 5, 2016, 9 pages.

International Search Report and Written Opinion in International Application No. PCT/KR2016/005667, dated Sep. 13, 2016, 12 pages.

Machine translation of JP H04-189400 A, dated Jul. 1992. (Year: 1992).

* cited by examiner

CLOTHES TREATING APPARATUS

CROSS-REFERENCE TO RELATED APPLICATION

This application is a continuation of U.S. application Ser. No. 15/166,543, filed on May 27, 2016, which claims the benefit of an earlier filing date of and the right of priority to Korean Application No. 10-2015-0078078, filed on Jun. 2, 2015, the contents of which are incorporated by reference herein in its entirety.

BACKGROUND

This specification generally relates to a clothes treating apparatus.

A clothes treating apparatus includes a washing machine washing clothes or laundry, a drying machine drying clothes, a washing/driving machine having washing and drying functions, and a refresher or a clothes management device refreshing clothes by supplying hot air to the clothes.

The drying machine includes a drum type drying machine that dries clothes in a spinning manner, and a so-called cabinet type drying machine that dries clothes while hanging the clothes.

Some clothes treating apparatuses, such as the drying machine, the washing/drying machine, the refresher and the clothes managing device, having the drying function, are provided with a spraying device or a spray unit that sprays a solution for restoring functionalities of clothes to be treated, for example, a wrinkle removal, a deodorization, a clothes shape recovery, a clothes lifespan expansion, and the like.

The spraying device of spraying the solution includes a spray nozzle for spraying the solution, and a pump for pumping the solution into the spray nozzle.

SUMMARY

In one aspect, a clothes treating apparatus includes a cabinet, a steam generator configured to generate steam, and a solution storing container configured to store a solution. The clothes treating apparatus also includes a steam spraying portion that is coupled to the steam generator and that is configured to spray steam and a solution spraying portion that is coupled to the solution storing container and that is configured to spray the solution. An outlet of the steam spraying portion is adjacent to an outlet of the solution spraying portion and the steam spraying portion is configured to spray steam to control air pressure at the outlet of the solution spraying portion.

Implementations may include one or more of the following features. For example, the clothes treating apparatus may include a fixed supporting portion configured to fixedly support the steam spraying portion and the solution spraying portion.

In some implementations, the clothes treating apparatus may include a movable supporting portion configured to support the solution spraying portion to be movable with respect to the steam spraying portion. In these implementations, the movable supporting portion may include a first coupling portion detachably coupled to the steam spraying portion. Further, in these implementations, the movable supporting portion may include a second coupling portion detachably coupled to the solution spraying portion.

In addition, the outlet of the steam spraying portion may be oriented toward a first direction, the outlet of the solution spraying portion may be oriented toward a second direction, and the first direction and the second direction may intersect at a certain angle. The certain angle may be in a range of 45 degrees to 90 degrees. Also, a diameter of the outlet of the steam spraying portion may be in a range of 1.0 mm to 2.0 mm. A diameter of the outlet of the solution spraying portion is in a range of 1.5 mm to 2.5 mm.

In some examples, the clothes treating apparatus may include an air supply device disposed in a first area inside the cabinet and the air supply device may be configured to condition temperature or humidity of air discharged from a second area inside the cabinet and return the conditioned air to the second area inside the cabinet. In these examples, the clothes treating apparatus may include a steam pipe, where a first end of the steam pipe is connected to the steam spraying portion and a second end of the steam pipe is connected to the steam generator that is disposed in the first area inside the cabinet. Further, in these examples, the clothes treating apparatus may include a second steam spraying portion configured to spray steam, a second solution spraying portion that is coupled to the solution storing container and that is configured to spray the solution, and a second steam pipe, where a first end of the second steam pipe is connected to the steam spraying portion and a second end of the steam pipe is connected to the steam generator.

In addition, the clothes treating apparatus may include a tub inside the cabinet, where the tub defines an inner space of the tub as the first area. In this case, the steam pipe may upwardly extend between the cabinet and the tub with the steam pipe being inserted into the tub. The steam spraying portion and the solution spraying portion may be disposed inside the cabinet and may be detachable from the cabinet.

In some implementations, the clothes treating apparatus may include a solution pipe, where a first end of the solution pipe is connected to the solution storing container and a second end of the solution pipe is connected to the solution spraying portion. The clothes treating apparatus also may include a switching valve configured to open and close the solution pipe. In these implementations, the clothes treating apparatus may include a discharge portion configured to discharge a solution through the solution pipe that is connected to the discharge portion, where the discharge portion is located at a lower portion of the solution storing container. Also, in these implementations, the clothes treating apparatus may include a mode selecting unit configured to determine that the solution is supplied to the second area inside the cabinet, and a controller configured to control the switching valve based on the determination that the solution is supplied to the second area inside the cabinet.

BRIEF DESCRIPTION OF THE DRAWINGS

Like reference numbers and designations in the various drawings indicate like elements.

DETAILED DESCRIPTION

Figure 1:
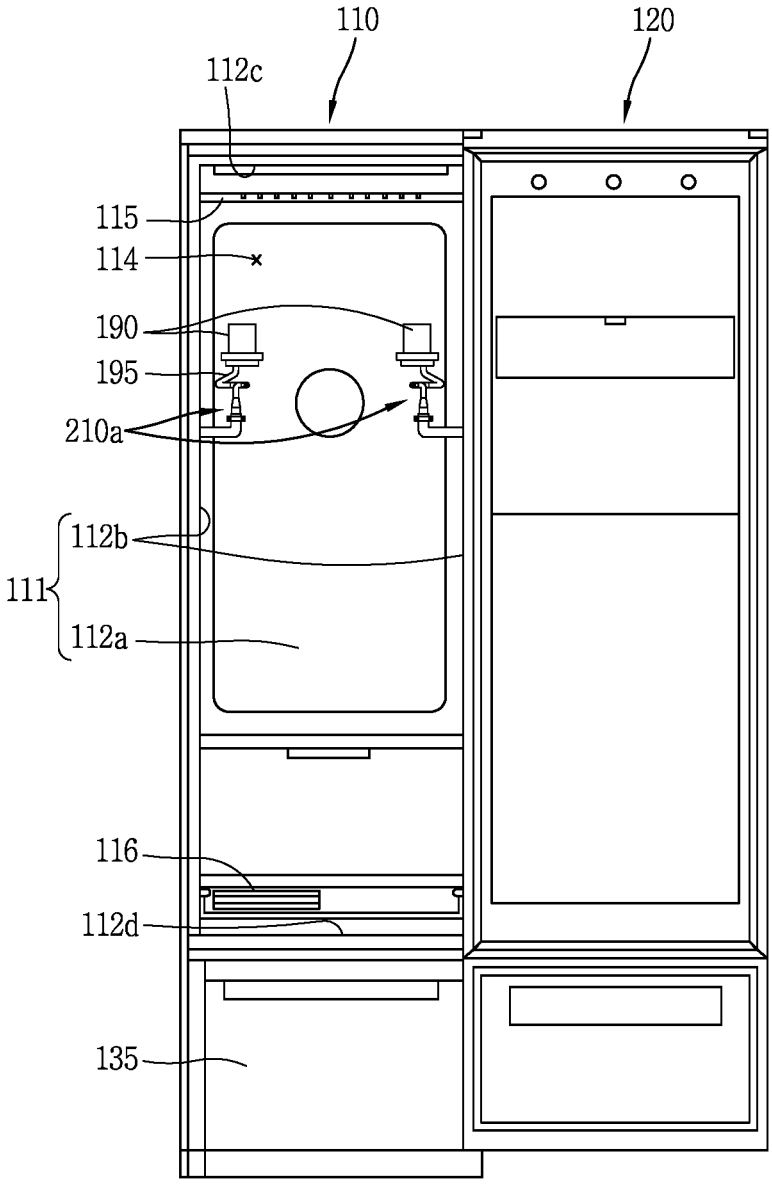
FIG. 1 is a diagram illustrating an inside of an example clothes treating apparatus.
Figure 2:
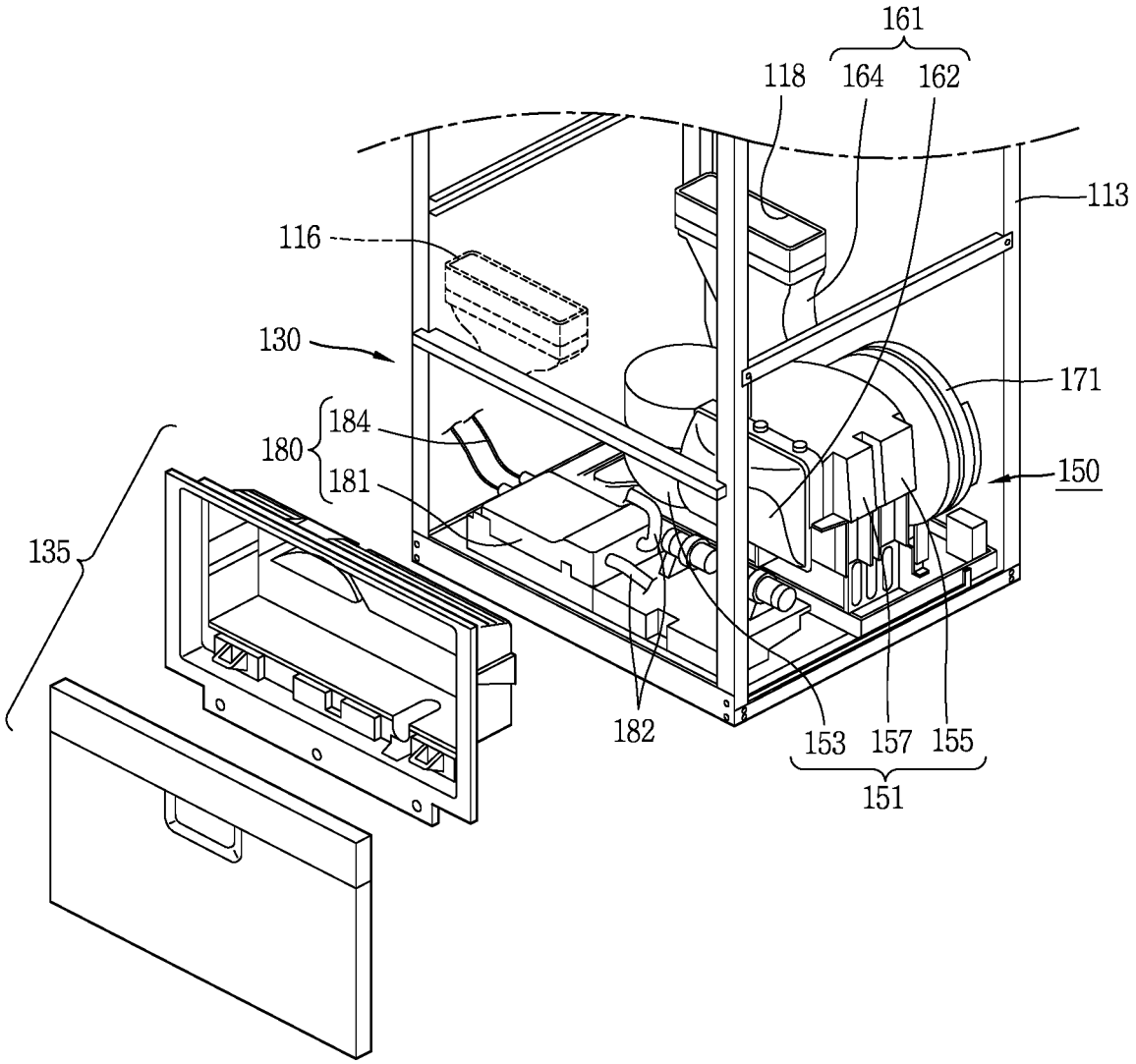
FIG. 2 is a diagram illustrating a bottom inside of an example clothes treating apparatus.

FIG. 1 illustrates an inside of an example clothes treating apparatus and FIG. 2 illustrates an example machine room of FIG. 1.

As illustrated in FIGS. 1 and 2, the clothes treating apparatus may include a cabinet 110 having an accommodating space 114 in which clothes to be treated is accommodated, a steam generator 180 for generating steam, a solution storing container 190 for storing a solution therein to recover a function of the clothes to be treated, and a spray unit 210*a* for spraying the steam and the solution into the accommodating space 114. The spray unit 210*a* may include a steam spraying portion 220 connected to the steam generator 180 for spraying the steam supplied from the steam generator 180, and a solution spraying portion 230 connected to the solution storing container 190 and having an outlet that is disposed at a negative pressure area 225 formed by the steam sprayed through the steam spraying portion 220 for spraying the solution of the solution storing container 190.

In some implementations, the solution refers to a liquid material containing an element which allows a recovery of a functionality of the clothes to be treated, for example, provides at least one of effects, such as a deodorization, a wrinkle removal, a clothes shape recovery and a clothes lifespan expansion.

The cabinet 110, for example, may have a rectangular parallelepiped shape in which the accommodating space 114 having a front opening is formed.

The cabinet 110 may have a frame 113 disposed to corresponding to each edge of the rectangular parallelepiped.

A door 121 for opening and closing the front opening may be rotatably provided at a front surface of the cabinet 110.

The accommodating space 114 may be provided at an upper area within the cabinet 110, and a machine room 130 for accommodating components therein may be provided at a lower area within the cabinet 110.

A supporting rod 115 on which the clothes to be treated is hung and supported may be provided within the accommodating space 114. The supporting rod 115 may be fixed in the accommodating space 114.

The supporting rod 115 may also be provided with a movable supporting rod, which is movable to apply a predetermined motion to the clothes to be treated.

An air outlet 116 and an air inlet 118 through which internal air is discharged or external air is introduced may be provided at the accommodating space 114.

In the machine room 130, an air supply device 150 is provided for supplying processed (e.g., dehumidified and/or heated) air into the accommodating space 114.

The air supply device 150, for example, may include a heat pump 151, which includes a compressor 153 compressing a refrigerant, a condenser 155 condensing the refrigerant in a radiating manner, an expansion device expanding the refrigerant, and an evaporator 157 by which the refrigerant is evaporated by absorbing latent heat.

The air supply device 150 may include a circulation passage 161 through which air within the accommodating space 114 circulates via an outside of the accommodating space 114, and a fan 171 for facilitating a flow of air.

The circulation passage 161, for example, may include a discharge duct 162 connected to the air outlet 116, and an introduction duct 164 connected to the air inlet 118.

In the circulation passage 161 may be provided the evaporator 157 that heat-exchanged with air discharged from the accommodating space 114.

With the configuration, the air discharged out of the accommodating space 114 may be cooled by the heat-exchange with the evaporator 157 and moisture contained in the air may be condensed and removed accordingly, thereby becoming dry air with low temperature.

The condenser 155 may be provided in the circulation passage 161.

The condenser 155 may be provided at a downstream side of the evaporator 157 along a flowing direction of the air.

With the configuration, the dry air with the low temperature, from which the moisture has been removed due to cooling by the evaporator 157, may be heated to increase temperature, and accordingly dry air with high temperature can be supplied back into the accommodating space 114.

In this exemplary implementation, the fan 171 is provided at a downstream side of the condenser 155, but the position of the fan 171 may appropriately be adjustable.

The steam generator 180 for generating steam may be provided at one side of the machine room 130, for example.

A door module 135 may be detachably provided on a front area of the machine room 130. The door module 135, for example, may be provided with a moisture supply portion for supplying moisture (or water) into the steam generator 180.

The steam generator 180, for example, may include a container 181 having a storage space in which water and steam are contained, and an electric heater 184 for heating the water within the container 181.

A steam pipe 182 through which steam within the container 181 is externally discharged may be connected to one side area of the container 181 of the steam generator 180.

The container 181 of the steam generator 180, for example, may be connected with a plurality steam pipes 182.

In some implementations, two steam pipes 182 are connected to the container 181 of the steam generator 180, but this is merely illustrative. The number of steam pipes connected may appropriately be adjustable.

In some implementations, an inner case or tub 111 (hereinafter, referred to as 'tub 111') which forms the accommodating space 114 may be provided within the cabinet 110.

The tub 111, for example, may have a rectangular parallelepiped shape with a front opening, and be provided with a rear surface portion 112*a*, both side surface portions 112*b*, an upper surface portion and a lower surface portion.

The spray unit 210*a* for spraying steam and the solution into the accommodating space 114 may be provided within the accommodating space 114.

The spray unit 210*a* may detachably be coupled to the tub 111.

The spray unit 210*a* may be fixed by a bracket 227 (see FIG. 3) which is detachably coupled to the tub 111.

The spray unit 210*a*, for example, may be provided in plurality.

The spray unit 210*a* may be provided by two in number to be coupled to the rear surface portion 112*a* or both side surface portions 112*b* of the tub 111.

The solution storing container 190 may be provided at one side of each spray unit 210*a* to supply the solution to the corresponding spray unit 210*a*.

Each solution storing container 190, for example, may have a cylindrical shape for accommodating the solution therein, and be provided with a discharge portion 192 (see FIG. 4) at a bottom surface thereof such that the solution can be discharged therethrough.

Each discharge portion 192 may be connected with a solution pipe 195 which forms a path of the solution such that the solution within the solution storing container 190 can flow toward the spray unit 210*a* through the discharge portion 192.

Each solution pipe 195, for example, may be provided with a switching valve 197 (see FIG. 3) for opening/closing the solution pipe 195.

This may allow for a selective supply of the solution into the accommodating space 114, and accordingly a supply of only steam into the accommodating space 114 may also be enabled.

The spray units 210*a* may be connected respectively to the steam pipes 182 which upwardly extend from the steam generator 180.

Each steam pipe 182, for example, may upwardly extend between a side wall of the tub 111 and a side wall of the cabinet 110 and be inserted into the tub 111 through the both side surface portions 112*b* of the tub 111, thereby being connected to each spray unit 210*a*.

Figure 3:
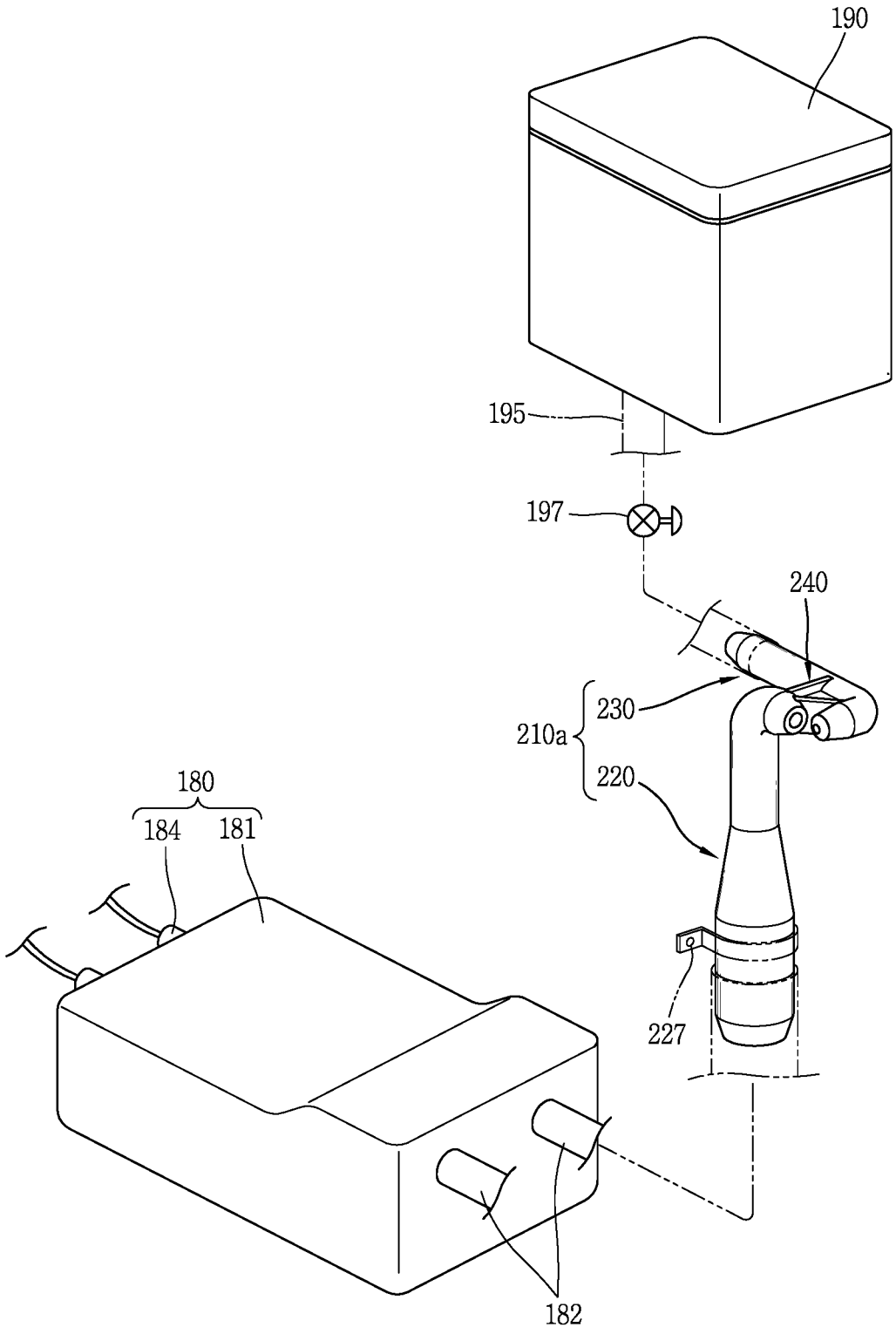
FIG. 3 is a diagram illustrating an example spray unit, an example steam generator, and an example solution storing container.
Figure 4:
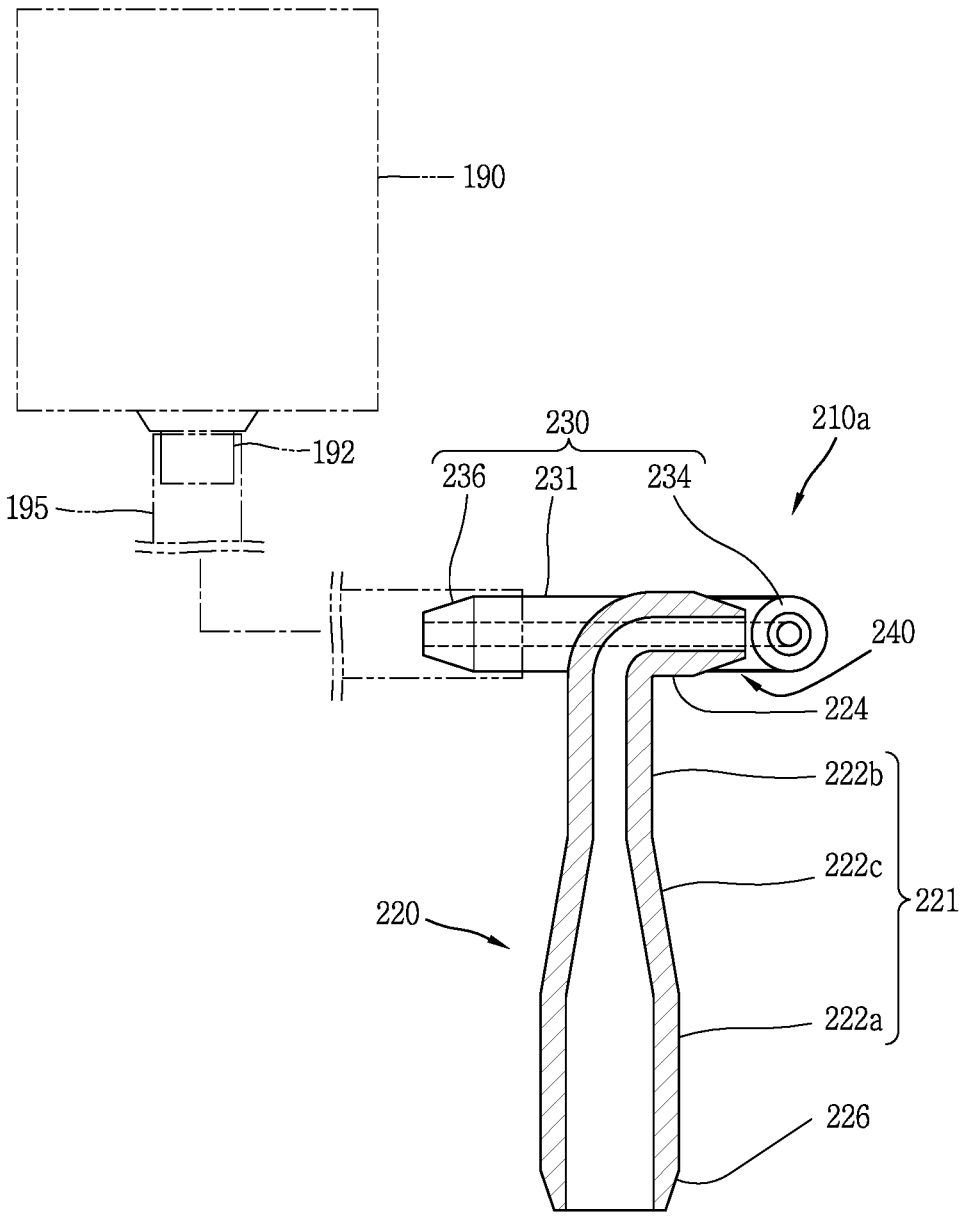
FIG. 4 is a diagram illustrating an example spray unit.
Figure 5:
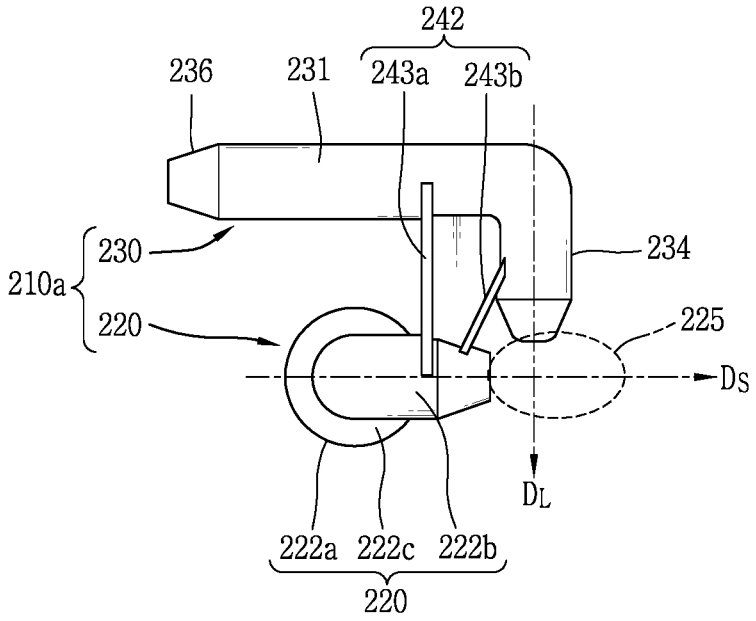
FIG. 5 is a diagram illustrating an example spray unit.

In some implementations, FIG. 3 illustrates an example spray unit, an example steam generator, and an example solution storing container. FIG. 4 illustrates an example spray unit. FIG. 5 illustrates an example spray unit.

As illustrated in FIGS. 3 to 5, the spray unit 210*a* may include a steam spraying portion 220 connected to the steam generator 180 to spray the steam supplied from the steam generator 180 therethrough, and a solution spraying portion 230 connected to the solution storing container 190 and having an outlet at a negative pressure area 225, which is formed by the steam sprayed through the steam spraying portion 220, to spray the solution within the solution storing container 190 therethrough.

The steam spraying portion 220 may be provided with a body 221 in a shape of a pipe in which a flow area (diameter) of steam is reduced.

The body 221 of the steam spraying portion 220, for example, as illustrated in FIG. 4, may include a large diameter part 222*a*, a small diameter part 222*b* having a diameter more reduced than that of the large diameter part 222*a*, and a variable diameter part 222*c* having one side connected to the large diameter part 222*a* and another side connected to the small diameter part 222*b* such that its inner diameter is gradually reduced.

Accordingly, steam introduced into the large diameter part 222*a* may flow fast due to the change in the flow cross-section. This may allow the steam to be externally sprayed through the small diameter part 222*b* at a preset speed.

A guide portion 226 which has a gradually-reduced outer width (or diameter) may be provided at an end portion of the large diameter part 222*a*.

The guide portion 226 may facilitate the large diameter part 222*a* to be inserted into another end portion of the steam pipe 182 whose one end portion is connected to the steam generator 180, which may allow the large diameter part 222*a* to be easily coupled to the steam pipe 182.

In some implementations, the small diameter part 222*b* may be provided with a negative pressure area 225 that is formed at an outlet side thereof during spraying of the steam. The negative pressure area 225 may have negative (−) pressure lower than atmospheric pressure.

The small diameter part 222*b* may have an inner diameter in the range of 1.0 mm to 2.0 mm, for example.

In some implementations, when the inner diameter of the small diameter part 222*b* exceeds 2.0 mm, it may make it difficult to form the negative pressure area at the outlet side of the steam spraying portion 220.

When the inner diameter of the small diameter part 222*b* is shorter than 1.0 mm, pressure applied to the small diameter part 222*b* may accumulatively increase, thereby causing damage on the small diameter part 222*b*.

A curved end portion 224, for example, may be formed at an end portion of the small diameter part 222*b*.

Accordingly, the spraying direction of the steam can be adjusted into a preset direction.

The curved end portion 224 of the small diameter part 222*b*, for example, may be configured in a manner that an outer width (or diameter) thereof is gradually reduced toward an end.

The solution spraying portion 230, for example, may be disposed in a manner that a spraying direction of the solution intersects with the spraying direction of the steam.

Accordingly, the solution sprayed through the solution spraying portion 230 may collide with the steam, which is sprayed at the preset speed, at a relatively fast speed, thereby being atomized.

The solution spraying portion 230, for example, may have a body 231 in a shape of a pipe, in which a passage with substantially the same diameter is formed.

The solution spraying portion 230 may have an inner diameter in the range of 1.5 mm to 2.5 mm.

This may prevent the solution spraying portion 230 from being blocked.

A guide portion 236 with a gradually-reduced outer width may be provided at one end portion of the solution spraying portion 230.

The guide portion 236 may facilitate an end portion of the solution spraying portion 230 to be inserted into the solution pipe 195, thereby allowing the solution spraying portion 230 and the solution pipe 195 to be easily coupled to each other.

The solution spraying portion 230 may be disposed in a manner that an outlet thereof is located within the negative pressure area 225 which is formed during spraying of the steam through the steam spraying portion 220.

Accordingly, the solution stored in the solution storing container 190 can flow to the solution spraying portion 230 along the solution pipe 195 by a pressure difference between internal pressure of the solution storing container 190 and pressure of the negative pressure area 225 and be sprayed through the solution spraying portion 230. For reference, in an open state of the passage of the solution pipe 195, when the steam is sprayed through the steam spraying portion 220, the negative pressure area may be formed at the outlet side of the steam spraying portion 220, and accordingly the outlet side of the solution spraying portion 230 may have lower pressure than the internal pressure of the solution storing container 190, regardless of an installed position of the solution storing container 190. Therefore, the solution within the solution storing container 190 can be sprayed through the outlet of the solution spraying portion 230.

The steam spraying portion 220 may have a spraying speed at which the steam sprayed through the small diameter part 222*b* can atomize the solution sprayed through the solution spraying portion.

For example, when the inner diameter of the small diameter part 222*b* is 2.0 mm and the spraying speed of the steam through the small diameter part 222*b* is 301.7 m/s, negative pressure (e.g., −0.12 bar) may be generated at an outlet area of the small diameter part 222*b* and additionally the solution sprayed through the solution spraying portion 230 can be atomized by colliding with the steam sprayed at the speed, and sprayed by being mixed with the steam.

With the configuration, the solution can first be atomized by the steam and sprayed by being mixed with the steam, which spreads to a relatively wide range. This may allow the solution to be brought into contact with the clothes to be treated at a relatively wide area.

The body 231 of the solution spraying portion 230, for example, may be provided with a curved end portion 234 which is curved approximately perpendicularly to a lengthwise direction.

Accordingly, an arrangement direction of the body 231 of the solution spraying portion 230 and the spraying direction of the solution can be adjusted into preset directions.

The curved end portion 234 of the solution spraying portion 230, for example, may be disposed perpendicular to the curved end portion 224 of the steam spraying portion 220.

The solution spraying portion 230 (body 231), for example, as illustrated in FIG. 5, may be arranged in parallel to the steam spraying direction Ds of the steam spraying portion 220.

In some implementations, the steam spraying portion 220 and the solution spraying portion 230 may integrally be fixed.

The spray unit 210*a*, for example, may include a fixed supporting portion 240 that supports the steam spraying portion 220 and the solution spraying portion 230 to be fixed to preset positions.

The fixed supporting portion 240, for example, may have one side connected to the steam spraying portion 220 and another side connected to the solution spraying portion 230.

In more detail, the fixed supporting portion 240 may fixedly support the steam spraying portion 220 and the solution spraying portion 230, in a state that the outlet of the solution spraying portion 230 is located in the negative pressure area 225 formed during spraying of the steam through the steam spraying portion 220.

Accordingly, the solution spraying portion 230 can spray the solution stored in the solution storing container 190, without a use of a separate component, such as a pump, by virtue of the pressure difference between the pressure of the negative pressure area formed at the outlet area of the steam spraying portion 220 during spraying of the steam through the steam spraying portion 220 and the internal pressure of the solution storing container 190.

The fixed supporting portion 240, for example, may be provided with a plurality of supporting plates 242 which connect the steam spraying portion 220 and the solution spraying portion 230 in an integral manner.

The fixed supporting portion 240, for example, as illustrated in FIG. 5, may include a first plate 243*a* having one end portion connected to the small diameter part 222*b* of the steam spraying portion 220 and another end portion connected to the body 231 of the solution spraying portion 230, and a second plate 243*b* having one end portion connected to the curved end portion 224 of the steam spraying portion 220 and another end portion connected to the curved end portion 234 of the solution spraying portion 230.

Figure 6:
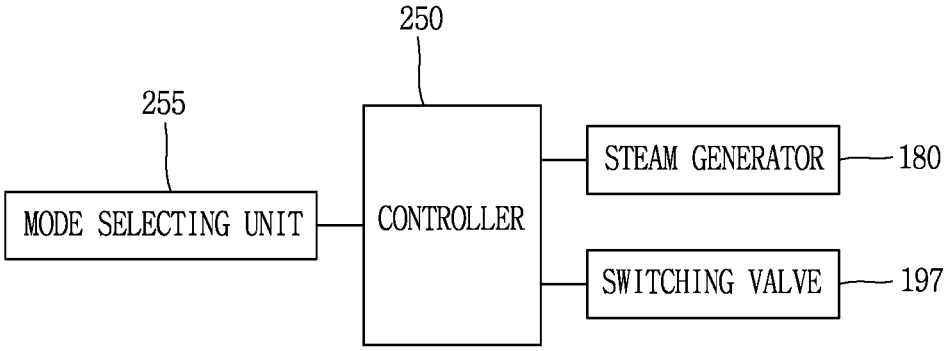
FIG. 6 is a block diagram illustrating an example clothes treating apparatus.

In some implementations, FIG. 6 illustrates a block diagram of an example clothes treating apparatus.

As illustrated in FIG. 6, the clothes treating apparatus may include a controller 250 for controlling the solution to be supplied in a manner of spraying steam.

The controller 250, for example, may be implemented as a microprocessor having a control program.

The controller 250 may be connected with a mode selecting unit 255 performing communication with the controller 250 and allowing for selecting a solution supply mode in which the solution is supplied.

The mode selecting unit 255, for example, may be configured to select a steam supply mode in which only steam is supplied into the accommodating space 114, without the solution supplied.

The controller 250 may be connected with the steam generator 180 and thus control the steam generator 180 to generate steam upon the selection of the solution supply mode through the mode selecting unit 255.

The controller 250 may be connected with the switching valve 197 and thus control the switching valve 197 to open or close the solution pipe 195.

With the configuration, when the clothes to be treated is accommodated in the accommodating space 114 and the solution supply mode is selected through the mode selecting unit 225, the controller 250 may control the steam generator 180 to generate steam.

The controller 250 may control the switching valve 197 to open the solution pipe 195.

The steam generated in the steam generator 180 may flow along the steam pipe 195 and be sprayed through the steam spraying portion 220.

When the steam is sprayed through the small diameter part 222*b* of the steam spraying portion 220, the negative pressure area 225 in which pressure is lower than atmospheric pressure may be formed at the outlet side of the small diameter part 222*b*.

When the negative pressure area 225 is formed due to the steam sprayed through the small diameter part 222*b*, the solution within the solution storing container 190 may flow along the solution pipe 195 and then be sprayed through the solution spraying portion 230.

The solution sprayed through the solution spraying portion 230 may be brought into contact in a colliding manner with the steam, which has been sprayed through the small diameter part 222*b* at the preset speed, thereby being atomized.

In addition to the atomization, the solution sprayed through the solution spraying portion 230 can also be mixed with the steam sprayed through the steam spraying portion 220. The atomized solution mixed with the steam may thusly be spread and sprayed to a relatively wide spraying range to be brought into contact with the clothes to be treated.

Accordingly, in the clothes treating apparatus disclosed herein, the solution can uniformly be sprayed to the relatively wide area of the clothes to be treated, thereby reducing the number of nozzles to be installed for spraying the solution.

Also, with the atomization of the solution, a requirement of many nozzles for spraying the solution, which is caused due to a narrow spraying range of the related art solution nozzle, can be obviated.

In addition, the related art problem of generating a portion where a solution and clothes are not in contact with each other, which is caused due to the solution being sprayed in a liquid state to a local range through a nozzle with a minute (or fine, small) diameter, can be prevented.

Also, the diameter of the spraying portion for spraying the solution can increase, thereby solving the problem of blocking a nozzle for spraying the solution.

FIGS. 7 to 10 illustrate other example spray units for a clothes treating apparatus.

Figure 7:
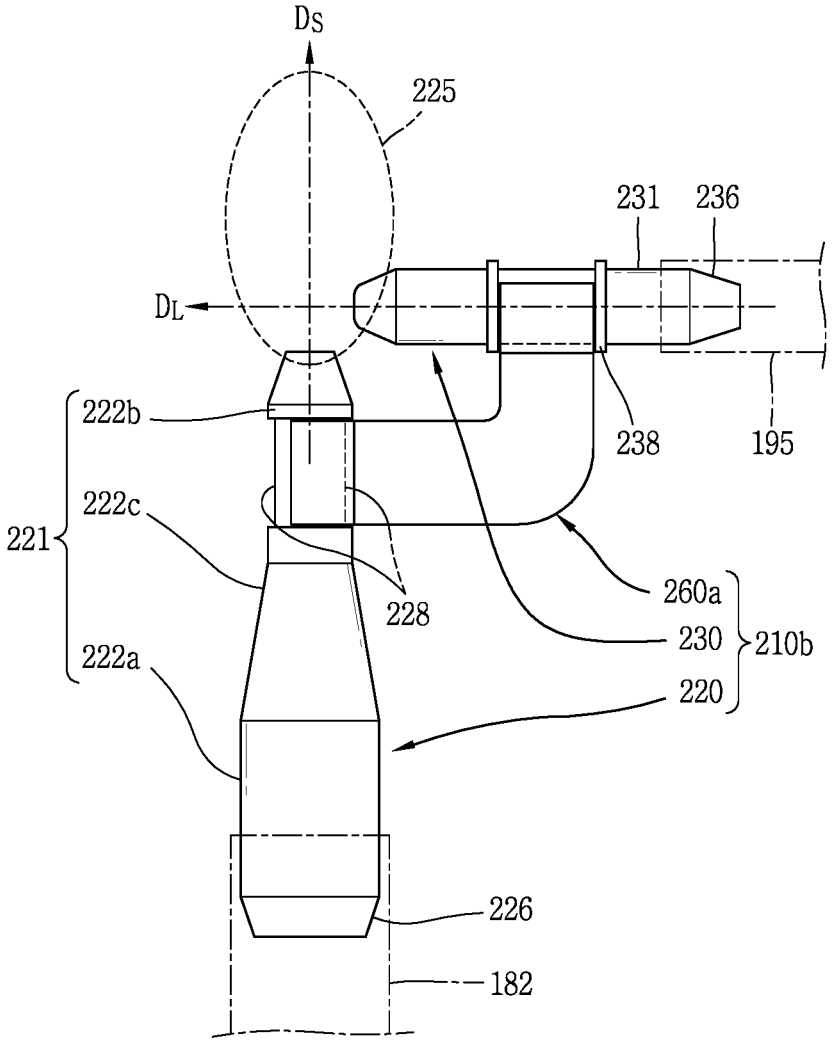
FIG. 7 is a diagram illustrating another example spray unit.
Figure 8:
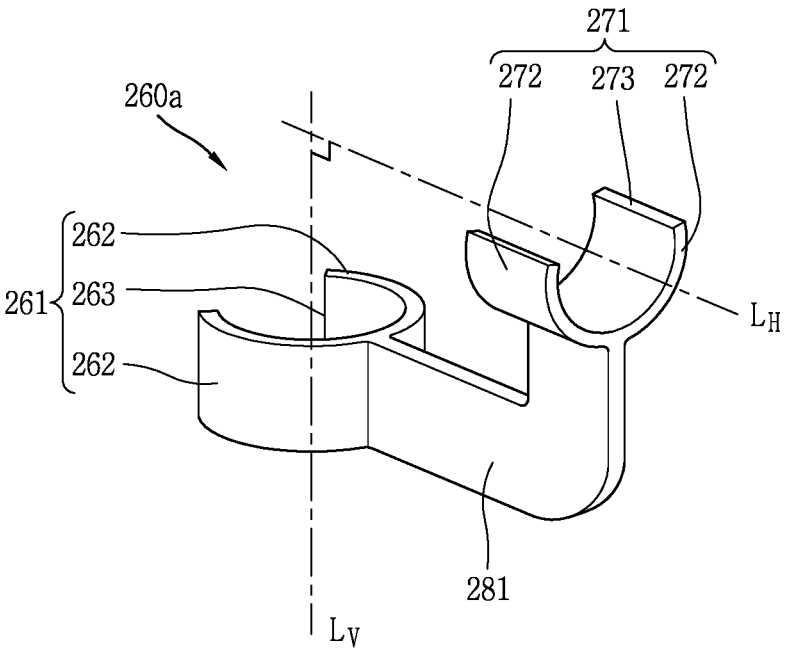
FIG. 8 is a diagram illustrating an example movable supporting portion.
Figure 9:
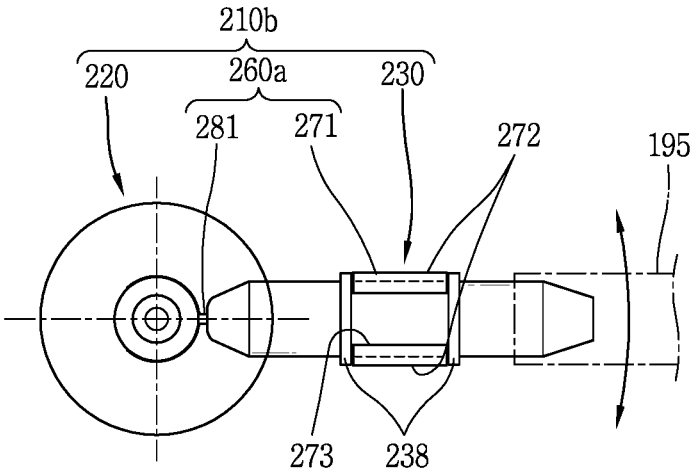
FIG. 9 is a diagram illustrating another example spray unit.
Figure 10:
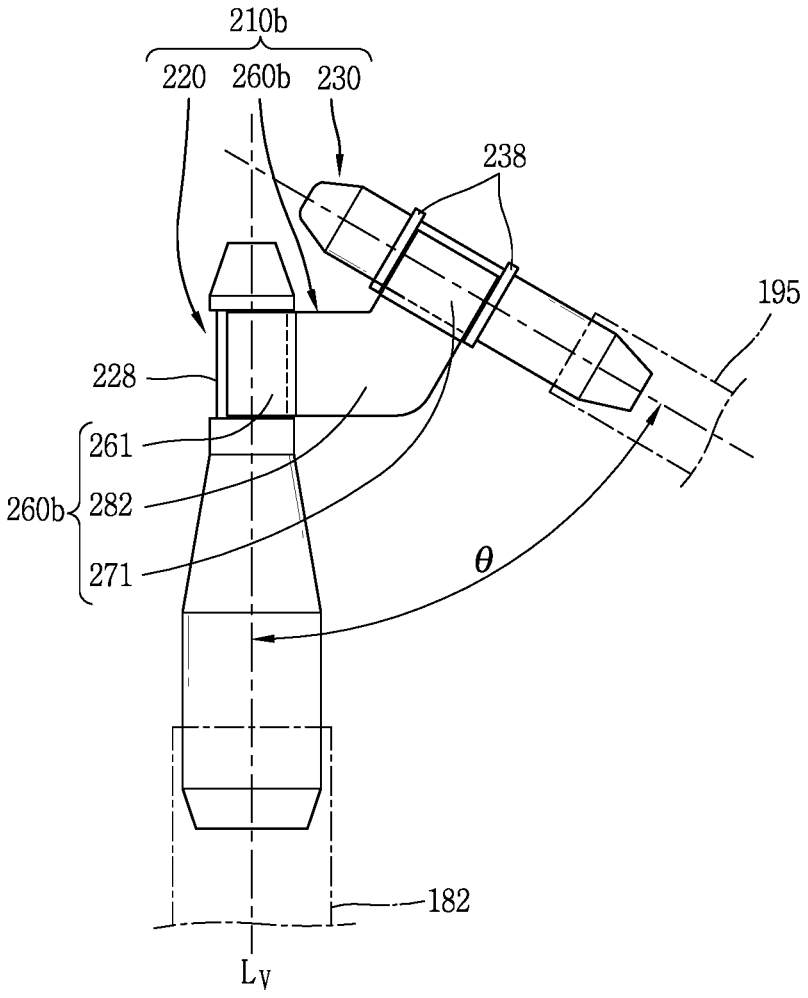
FIG. 10 is a diagram illustrating another example spray unit.

FIG. 7 illustrates another example spray unit. FIG. 8 illustrates an example movable supporting portion. FIG. 9 illustrates another example spray unit. FIG. 10 illustrates another example spray unit.

The clothes treating apparatus may include a cabinet 110 having an accommodating space 114 for accommodating clothes to be treated therein, a steam generator 180 for generating steam, a solution storing container 190 for storing therein a solution for recovering a function of the clothes to be treated, and a spray unit 210*b* for spraying the steam and the solution into the accommodating space 114. The spray unit 210*b* may include a steam spraying portion 220 connected to the steam generator 180 to spray the steam generated in the steam generator 180, and a solution spraying portion 230 connected to the solution storing container 190 and having an outlet disposed at a negative pressure area 225 formed by the steam sprayed through the steam spraying portion 220 so as to spray the solution of the solution storing container 190.

The spray unit 210*b*, for example, as illustrated in FIG. 7, may include a steam spraying portion 220 in a linear shape, and a solution spraying portion 230 disposed perpendicular to the steam spraying portion 220.

The spray unit 210*b*, for example, may be provided with a movable supporting portion 260*a* which supports the solution spraying portion 230 to be relatively movable with respect to the steam spraying portion 220 in a state that the outlet of the solution spraying portion 230 is disposed in the negative pressure area 225 of the steam spraying portion 220.

The movable supporting portion 260*a*, for example, may be detachably coupled to the steam spraying portion 220.

The movable supporting portion 260*a*, for example, may be detachably coupled to the solution spraying portion 230.

In more detail, the movable supporting portion 260*a*, as illustrated in FIG. 8, may be provided with a steam spraying portion coupling portion 261 detachably coupled to the steam spraying portion 220.

The movable supporting portion 260*a* may be provided with a solution spraying portion coupling portion 271 detachably coupled to the solution spraying portion 230.

The steam spraying portion coupling portion 261, for example, may be coupled to an outer surface of the small diameter part 222*b*.

The steam spraying portion coupling portion 261, for example, may have both side walls 262 which are arranged into an arcuate shape having an opening 263 at one side such that the small diameter part 222*b* is accommodated therein.

The steam spraying portion coupling portion 261 may be configured to perform a relative motion (rotation) with respect to the steam spraying portion 220 after being coupled to the steam spraying portion 220.

This may allow for adjusting a relative position of the solution spraying portion 230 with respect to the steam spraying portion 220, which may prevent an occurrence of interference between the solution spraying portion 230 and/or the solution pipe 195 and adjacent components.

Upon coupled to the small diameter part 222*b*, the opening 263 between the both side walls 262 of the steam spraying portion coupling portion 261 may be externally widened by elastic force of the side walls 262 to have an increased width. After being coupled, the opening 263 between the both side walls 262 of the steam spraying portion coupling portion 261 may be recovered to its original position (or original state) by the elastic force.

The solution spraying portion coupling portion 271, for example, may be coupled to an outer surface of the body 231 of the solution spraying portion 230.

The solution spraying portion coupling portion 271, for example, may have both side walls 272 which are arranged into an arcuate shape having an opening 273 at one side such that the body 231 of the solution spraying portion 230 is accommodated therein.

Upon being coupled to the solution spraying portion 230, the opening 273 between the both side walls 272 may be externally widened. After being coupled, the opening 273 of the both side walls 272 may be recovered by elastic force of the side walls 272 to its original position (or original state) at which the opening 273 has its initial width between the both sides walls.

The movable supporting portion 260*a* may have a connector 281 through which the steam spraying portion coupling portion 261 and the solution spraying portion coupling portion 271 are integrally connected to each other.

The connector 281, for example, may allow the steam spraying portion coupling portion 261 and the solution spraying portion coupling portion 271 to be perpendicular to each other.

As illustrated in FIG. 10, a movable supporting portion 260*b* may include a connector 282 by which the steam spraying portion coupling portion 261 and the solution spraying portion coupling portion 271 are arranged to form an inner angle corresponding to a preset tilt angle θ (e.g., 45°).

This example illustrates that the movable supporting portion 260*b* is formed in the manner that the inner angle between the steam spraying portion coupling portion 261 and the solution spraying portion coupling portion 271 is 45°, but the inner angle between the steam spraying portion coupling portion 261 and the solution spraying portion coupling portion 271 may appropriately be adjustable.

In some implementations, the steam spraying portion 220 may be provided with a stopper 228 which enables the rotation of the steam spraying portion coupling portion 261 and simultaneously prevents the steam spraying portion coupling portion 261 from being loosened in a lengthwise direction (axial direction).

The stopper 228, for example, may be formed in a shape of a groove (or recess) recessed into the outer surface of the small diameter part 222*b* in a radial direction.

The solution spraying portion 230, for example, may be provided with a stopper 238 which prevents the solution spraying portion coupling portion 271 from being loosened in a lengthwise direction (axial direction) of the solution spraying portion 230 after the solution spraying portion coupling portion 271 is coupled.

The stopper 238 of the solution spraying portion 230, for example, may be formed in a shape of outwardly protruding from the outer surface of the body 231 of the solution spraying portion 230 in a radial direction.

This example illustrates that the steam spraying portion 220 is provided with the stopper 228 in the shape of the recessed groove, and the solution spraying portion 230 is provided with the stopper 238 in a protruded shape. However, the present invention may not be limited to this. A stopper protruding in a radial direction may be formed on the steam spraying portion 220 and a stopper in a shape of a groove recessed in a radial direction may be formed on the outer surface of the solution spraying portion 230.

As described above, the solution can be sprayed without using a pump. Thus, the spray unit can reduce noise caused by a pump.

Also, since a pump is not used in the spray unit, it reduces the manufacturing cost for the spray unit.

The solution can be sprayed by being atomized and a sprayed range of the solution can be widened, which may allow a reduction of number of spray nozzles. This may also result in the reduction of the component costs.

The solution can be uniformly sprayed to clothes to be treated after being atomized and mixed with steam, which may facilitate a realization of the original purpose of the solution.

An inner diameter of a spray nozzle of the solution can increase, which may result in facilitating a fabrication of the spray nozzle and preventing the spray nozzle of the solution from being blocked.

Also, a movable supporting portion may be provided to support the solution spraying portion to be relatively movable with respect to the steam spraying portion in a state that an outlet of the solution spraying portion is disposed in a negative pressure area of the steam spraying portion. This may allow for adjusting relative positions of the steam spraying portion and the solution spraying portion, resulting in preventing interference with adjacent components.

What is claimed is:

1. A clothes treating apparatus, comprising:

a cabinet that defines an accommodating space configured to receive clothes to be treated;

a steam generator configured to generate steam;

a solution storing container disposed at the accommodating space and configured to store a solution for treating the clothes;

a steam spraying portion that is disposed in the accommodating space, that is coupled to the steam generator, and that is configured to spray steam;

a solution spraying portion that is disposed in the accommodating space, that is coupled to the solution storing container, and that is configured to spray the solution, the solution spraying portion being spaced apart from the solution storing container and disposed vertically below the solution storing container;

a movable supporting portion configured to support the steam spraying portion and the solution spraying portion, the movable supporting portion comprising:

a steam spraying portion coupling portion detachably coupled to the steam spraying portion and configured to allow rotation of the steam spraying portion in the steam spraying portion coupling portion, a solution spraying portion coupling portion detachably coupled to the solution spraying portion, and a connector that connects the steam spraying portion coupling portion and the solution spraying portion coupling portion to each other;

a solution pipe that connects the solution storing container to the solution spraying portion and that is configured to guide the solution in the solution storing container to the solution spraying portion by gravity; and a switching valve disposed at the solution pipe and configured to open and close at least a portion of the solution pipe, wherein the steam spraying portion has an outlet disposed adjacent to an outlet of the solution spraying portion, the steam spraying portion being configured to spray steam to control air pressure at the outlet of the solution spraying portion, wherein the steam spraying portion coupling portion comprises a first side wall that has an arc shape defined by a first end and a second end and that surrounds a portion of a circumference of the steam spraying portion, the first side wall defining a first opening configured to receive the steam spraying portion and disposed between the first end of the first side wall and the second end of the first side wall, wherein the solution spraying portion coupling portion comprises a second side wall that has an arc shape defined by a first end and a second end and that surrounds a portion of a circumference of the solution spraying portion, the second side wall defining a second opening configured to receive the solution spraying portion and disposed between the first end of the second side wall and the second end of the second side wall, wherein an arc length of the first side wall is greater than a half of a length of the circumference of the steam spraying portion, and wherein an arc length of the second side wall is greater than a half of a length of the circumference of the solution spraying portion.

2. The apparatus of claim 1, wherein the movable supporting portion is configured to support the solution spraying portion and allow the solution spraying portion to be movable with respect to the steam spraying portion.

3. The apparatus of claim 1, wherein the outlet of the steam spraying portion is oriented toward a first direction, and wherein the outlet of the solution spraying portion is oriented toward a second direction that intersects the first direction and defines a predetermined angle with respect to the first direction.

4. The apparatus of claim 3, wherein the predetermined angle is in a range from 45 degrees to 90 degrees.

5. The apparatus of claim 1, wherein a diameter of the outlet of the steam spraying portion is in a range from 1.0 mm to 2.0 mm.

6. The apparatus of claim 1, wherein a diameter of the outlet of the solution spraying portion is in a range from 1.5 mm to 2.5 mm.

7. The apparatus of claim 1, wherein the cabinet has a first area and a second area inside the cabinet, and wherein the apparatus further comprises an air supply device disposed in the first area and configured to condition a temperature or humidity of air discharged from the second area and to return the conditioned air to the second area.

8. The apparatus of claim 7, further comprising:

a mode selecting unit configured to determine whether the solution is supplied to the second area inside the cabinet; and a controller configured to control the switching valve based on a determination that the solution is supplied to the second area inside the cabinet.

9. The apparatus of claim 7, further comprising a steam pipe having a first end connected to the steam spraying portion and a second end connected to the steam generator, wherein the steam generator is disposed in the first area inside the cabinet.

10. The apparatus of claim 9, further comprising:

an additional steam spraying portion configured to spray steam;

an additional solution spraying portion coupled to the solution storing container and configured to spray the solution; and an additional steam pipe having a first end connected to the steam spraying portion and a second end connected to the steam generator.

11. The apparatus of claim 9, further comprising a tub that is disposed inside the cabinet and that defines an inner space therein, the second area inside the cabinet corresponding to the inner space of the tub.

12. The apparatus of claim 11, wherein the steam pipe upwardly extends through a space defined between the cabinet and the tub and is inserted into the tub.

13. The apparatus of claim 11, wherein the tub faces the accommodating space, and wherein the solution storing container is disposed at an inner surface of the tub.

14. The apparatus of claim 1, wherein each of the steam spraying portion and the solution spraying portion is configured to be disposed inside the cabinet and detached from the cabinet.

15. The apparatus of claim 1, wherein the solution pipe has a first end connected to the solution storing container and a second end connected to the solution spraying portion.

16. The apparatus of claim 15, further comprising a discharge portion that is located at a lower portion of the solution storing container, that is connected to the solution pipe, and that is configured to discharge the solution through the solution pipe.

17. The apparatus of claim 1, wherein the steam spraying portion comprises:

a first body that extends in a first axial direction of the steam spraying portion; and first stoppers that protrude in a first radial direction of the steam spraying portion from an outer circumferential surface of the first body and that are configured to restrict movement of the steam spraying portion coupling portion along the first body, the first stoppers being spaced apart from each other by an interval corresponding to a length of the first side wall of the steam spraying portion coupling portion in the first axial direction, wherein the solution spraying portion comprises:

a second body that extends in a second axial direction of the solution spraying portion, and a second stopper that is recessed inward from an outer circumferential surface of the second body in a second radial direction of the solution spraying portion and that is configured to receive the second side wall of the solution spraying portion coupling portion to thereby restrict movement of the solution spraying portion coupling portion along the second body, and wherein a length of the second stopper in the second axial direction of corresponds to a length of the second side wall of the solution spraying portion coupling portion in the second axial direction.

18. The apparatus of claim 1, wherein the cabinet comprises:

an upper portion that defines the accommodating space; and a lower portion that defines a machine room that accommodates an air supply device configured to supply conditioned air to the accommodating space, and wherein the solution storing container is disposed at a position vertically above the machine room.

19. The apparatus of claim 18, wherein the steam generator is disposed in the machine room and comprises a container configured to receive water and a heater configured to heat the water in the container.

20. The apparatus of claim 1, wherein the solution storing container is disposed within the accommodating space and spaced apart from an inner surface of the cabinet.

* * * * *